US012063964B2

(12) United States Patent
Phillips et al.

(10) Patent No.: US 12,063,964 B2
(45) Date of Patent: Aug. 20, 2024

(54) APPARATUS FOR HEATING AEROSOL-GENERATING MATERIAL

(71) Applicant: NICOVENTURES TRADING LIMITED, London (GB)

(72) Inventors: Jeremy Phillips, London (GB); Pablo Javier Ballesteros Gomez, London (GB)

(73) Assignee: NICOVENTURES TRADING LIMITED, London (GB)

( * ) Notice: Subject to any disclaimer, the term of this patent is extended or adjusted under 35 U.S.C. 154(b) by 993 days.

(21) Appl. No.: 15/733,414

(22) PCT Filed: Jan. 24, 2019

(86) PCT No.: PCT/EP2019/051804
§ 371 (c)(1),
(2) Date: Jul. 23, 2020

(87) PCT Pub. No.: WO2019/145451
PCT Pub. Date: Aug. 1, 2019

(65) Prior Publication Data

US 2021/0093001 A1 Apr. 1, 2021

(30) Foreign Application Priority Data

Jan. 25, 2018 (GB) ..... 1801257

(51) Int. Cl.
*A24F 40/46* (2020.01)
*A24F 40/30* (2020.01)
(Continued)

(52) U.S. Cl.
CPC ..... *A24F 40/46* (2020.01); *A24F 40/30* (2020.01); *A24F 40/42* (2020.01); *A24D 1/20* (2020.01); *A24F 40/20* (2020.01)

(58) Field of Classification Search
None
See application file for complete search history.

(56) References Cited

U.S. PATENT DOCUMENTS 5,178,167 A 1/1993 Riggs et al.
5,865,185 A 2/1999 Collins et al.
(Continued)

FOREIGN PATENT DOCUMENTS

CN 105411005 A 3/2016
EP 0174645 A2 3/1986
(Continued)

OTHER PUBLICATIONS

"Decision to Grant received for Japanese Patent Application No. 2020-537147, mailed on Jan. 18, 2022", 5 pages (2 pages of English Translation and 3 pages of Official Copy).
(Continued)

*Primary Examiner* — Ross N Gushi
(74) *Attorney, Agent, or Firm* — Husch Blackwell

(57) ABSTRACT

There is provided an apparatus arranged to heat aerosol-generating material to volatilize at least one component of the aerosol-generating material. The apparatus includes a housing including a first opening and a chamber including a first section and a second section. A first consumable article including aerosol-generating material can be inserted through the first opening to be received within the first section of the chamber in use. The apparatus further includes a heater arrangement within the housing for heating the aerosol-generating material received within the first section of the chamber in use to generate a flow of aerosol. The second section of the chamber is upstream of the first section of the chamber and is configured to receive a second consumable article comprising a flavorant.

17 Claims, 6 Drawing Sheets

(51) Int. Cl.

| | |
|---|---|
| ***A24F 40/42*** | (2020.01) |
| *A24D 1/20* | (2020.01) |
| *A24F 40/20* | (2020.01) |

(56) References Cited

U.S. PATENT DOCUMENTS

| | | | | |
|---|---|---|---|---|
| 2005/0244521 | A1 | 11/2005 | Strickland et al. | |
| 2006/0174901 | A1 | 8/2006 | Karles et al. | |
| 2008/0092912 | A1 | 4/2008 | Robinson et al. | |
| 2012/0006346 | A1 | 1/2012 | Inagaki | |
| 2016/0135506 | A1* | 5/2016 | Sanchez | A24F 40/30 131/329 |
| 2016/0235122 | A1* | 8/2016 | Krietzman | A24B 15/16 |

FOREIGN PATENT DOCUMENTS

| | | | | |
|---|---|---|---|---|
| EP | 0336458 | A2 | 10/1989 | |
| EP | 0337505 | A2 | 10/1989 | |
| EP | 0342538 | A2 | 11/1989 | |
| EP | 3075272 | A2 | 10/2016 | |
| EP | 3261468 | A2 | 1/2018 | |
| JP | 2010506594 | A | 3/2010 | |
| JP | 2016508744 | A | 3/2016 | |
| JP | 2017511703 | A | 4/2017 | |
| JP | 2017515493 | A | 6/2017 | |
| JP | 2017529896 | A | 10/2017 | |
| KR | 20150132112 | A | 11/2015 | |
| KR | 20160112770 | A | 9/2016 | |
| KR | 2627004 | C2 | 8/2017 | |
| RU | 2595971 | C2 | 8/2016 | |
| WO | 2014139611 | A1 | 9/2014 | |
| WO | 2015166952 | A1 | 11/2015 | |
| WO | 2016135342 | A2 | 9/2016 | |
| WO | WO 2016/207407 | A1 * | 12/2016 | A24F 47/00 |
| WO | 2017194764 | A1 | 11/2017 | |
| WO | 2017207443 | A1 | 12/2017 | |

OTHER PUBLICATIONS

"International Preliminary Report on Patentability received for PCT Patent Application No. PCT/EP2019/051804, mailed on Aug. 6, 2020", 8 pages.

"International Search Report and Written Opinion received for PCT Patent Application No. PCT/EP2019/051804, mailed on May 14, 2019", 12 pages.

"Reasons for Refusal received for Japanese Patent Application No. 2020-537147, mailed on Jun. 29, 2021", 8 pages (4 pages of English Translation and 4 pages of Official Copy).

"Preliminary Rejection received for Korean Patent Application No. 10-2023-7017490, mailed on Dec. 20, 2023", 10 pages (5 pages of English Translation and 5 pages of Official Copy).

* cited by examiner

APPARATUS FOR HEATING AEROSOL-GENERATING MATERIAL

PRIORITY CLAIM

The present application is a National Phase entry of PCT Application No. PCT/EP2019/051804, filed Jan. 24, 2019, which claims priority from GB Patent Application No. 1801257.5, filed Jan. 25, 2018, each of which is hereby fully incorporated herein by reference.

TECHNICAL FIELD

The present disclosure relates to apparatus arranged to heat aerosol-generating material.

BACKGROUND

Articles such as cigarettes, cigars and the like burn tobacco during use to create tobacco smoke. Attempts have been made to provide alternatives to these articles, which burn tobacco, by creating products that release compounds without burning. Examples of such products are so-called heat-not-burn products, also known as tobacco heating products or tobacco heating devices, which release compounds by heating, but not burning, the material. The material may be for example tobacco or other non-tobacco products or a combination, such as a blended mix, which may or may not contain nicotine.

SUMMARY

According to a first aspect of the present disclosure, there is provided an apparatus arranged to heat aerosol-generating material to volatilize at least one component of said aerosol-generating material, the apparatus comprising: a housing; the housing comprising a first opening and a chamber comprising a first section and a second section, wherein a first consumable article comprising aerosol-generating material can be inserted through the first opening to be received within the first section of the chamber in use; a heater arrangement within the housing for heating the aerosol-generating material received within the first section of the chamber in use to generate a flow of aerosol; wherein the second section of the chamber is upstream of the first section of the chamber and is configured to receive a second consumable article comprising a flavorant.

The housing may comprise a second opening, wherein the second consumable article can be inserted into the second section of the chamber through the second opening.

In some examples, a user can access the chamber through the second opening to clean within the apparatus.

In some examples, the first opening is at a first end of the apparatus and the second opening is at a second end of the apparatus.

In some examples, the first opening is at a proximal end of the apparatus and the second opening is at a distal end of the device.

The apparatus may further comprise a door for selectively covering the second opening, the door being movable between a first position in which the second opening is closed by the door and a second position in which the second opening is open.

According to a second aspect of the present disclosure, there is provided a system comprising the apparatus of the first aspect and a second consumable for being received in the second section.

According to a third aspect of the disclosure, there is provided a method of using the apparatus of the first aspect, the method comprising: inserting a first consumable article comprising aerosol-generating material through the first opening to be received within the first section of the chamber; inserting a second consumable article comprising a flavorant into the second section of the chamber upstream of the first section of the chamber; using the heater arrangement to heat the aerosol-generating material received within the first section of the chamber generate a flow of aerosol; and generating a flow of flavorant from the second consumable article.

BRIEF DESCRIPTION OF THE DRAWINGS

Embodiments of the disclosure will now be described, by way of example only, with reference to the accompanying drawings, in which.

DETAILED DESCRIPTION

As used herein, the term "aerosol-generating material" includes materials that provide volatilized components upon heating, typically in the form of an aerosol. "Aerosol-generating material" includes any tobacco-containing material and may, for example, include one or more of tobacco, tobacco derivatives, expanded tobacco, reconstituted tobacco or tobacco substitutes. "Aerosol-generating material" also may include other, non-tobacco, products, which, depending on the product, may or may not contain nicotine. "Aerosol-generating material" may for example be in the form of a solid, a liquid, a gel or a wax or the like. "Aerosol-generating material" may for example also be a combination or a blend of materials.

Apparatus is known that heats aerosol-generating material to volatilize at least one component of the aerosol-generating material, typically to form an aerosol which can be inhaled, without burning or combusting the aerosol-generating material. Such apparatus is sometimes described as a "heat-not-burn" apparatus or a "tobacco heating product" or "tobacco heating device" or similar. Similarly, there are also so-called e-cigarette devices, which typically vaporize an aerosol-generating material in the form of a liquid, which may or may not contain nicotine. The aerosol-generating material may be in the form of or provided as part of a rod, cartridge or cassette or the like which can be inserted into the apparatus. A heater for heating and volatilizing the aerosol-generating material may be provided as a "permanent" part of the apparatus or may be provided as part of the smoking article or consumable which is discarded and replaced after use. A "smoking article" in this context is a device or article or other component that includes or contains in use the aerosol-generating material, which in use is heated to volatilize the aerosol-generating material, and optionally other components.

Figure 1:
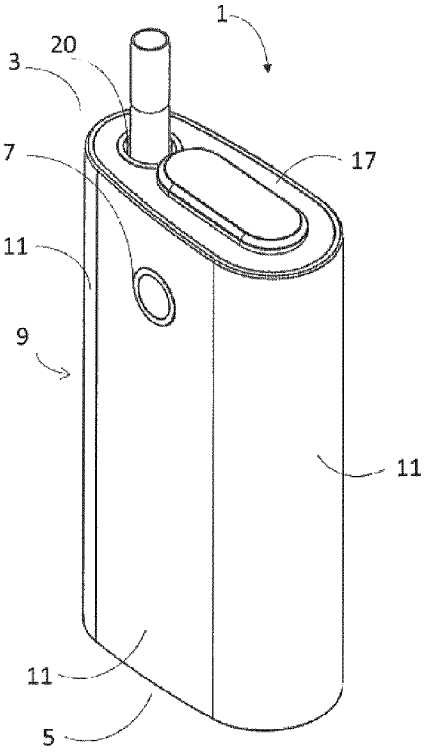
FIG. 1 shows a perspective view of an example of an apparatus for heating an aerosol-generating material.
Figure 2:
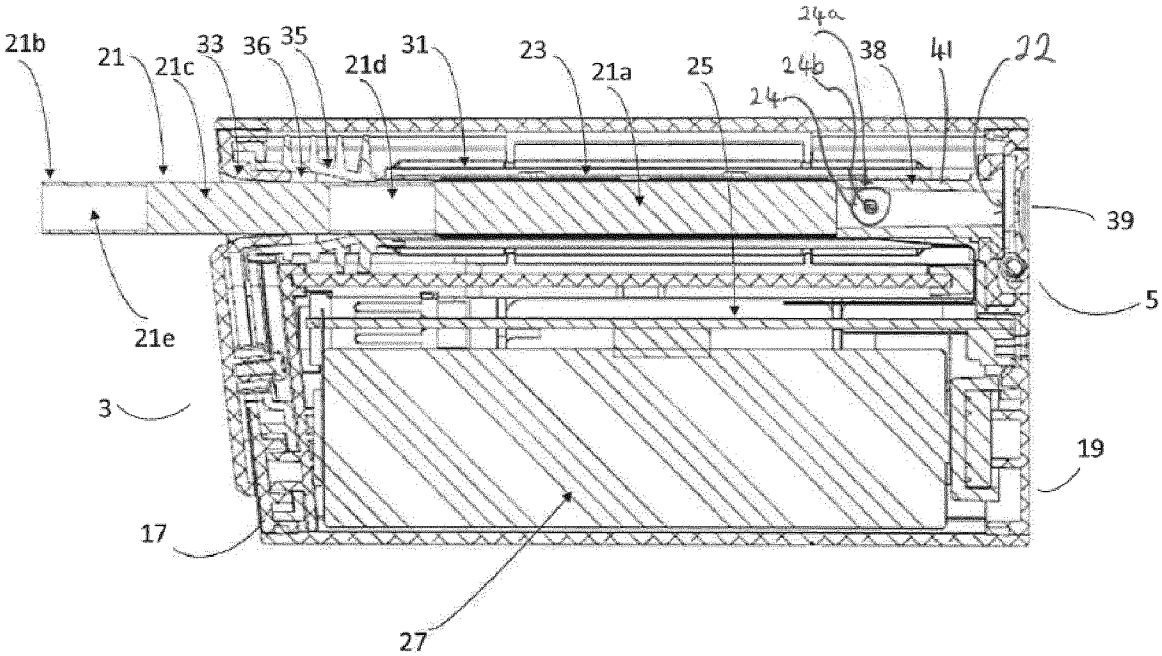
FIG. 2 shows a lateral cross-sectional view of the apparatus of FIG. 1 with a first consumable article and a second consumable article inserted.
Figure 3:
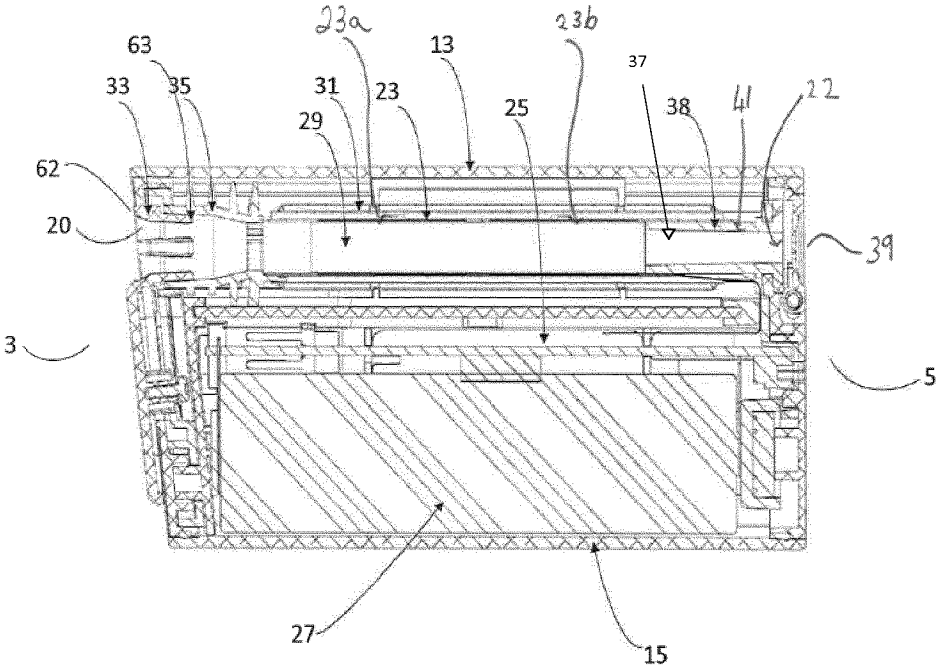
FIG. 3 shows a lateral cross-sectional view of the apparatus of FIG. 1 without a first consumable article and a second consumable article inserted.

Referring initially to FIGS. 1 to 3, there is shown an example of an apparatus 1 arranged to heat aerosol-generating material to volatilize at least one component of said aerosol-generating material, typically to form an aerosol which can be inhaled. The apparatus 1 is a heating apparatus 1 which releases compounds by heating, but not burning, the aerosol-generating material.

A first end 3 is sometimes referred to herein as the mouth or proximal end 3 of the apparatus 1 and a second end 5 is sometimes referred to herein as the distal end 5 of the apparatus 1. The apparatus 1 has an on/off button 7 to allow the apparatus 1 as a whole to be switched on and off as desired by a user.

The apparatus 1 comprises a housing 9 for locating and protecting various internal components of the apparatus 1. In the example shown, the housing 9 comprises a uni-body sleeve 11 that encompasses the perimeter of the apparatus 1, capped with a top panel 17 which defines generally the 'top' of the apparatus 1 and a bottom panel 19 which defines generally the 'bottom' of the apparatus 1.

The top panel 17 and/or the bottom panel 19 may be removably fixed to the uni-body sleeve 11, to permit easy access to the interior of the apparatus 1, or may be "permanently" fixed to the uni-body sleeve 11, for example to deter a user from accessing the interior of the apparatus 1. In an example, the panels 17 and 19 are made of a plastics material, including for example glass-filled nylon formed by injection molding, and the uni-body sleeve 11 is made of aluminum, though other materials and other manufacturing processes may be used.

The top panel 17 of the apparatus 1 has a first opening 20 at the mouth end 3 of the apparatus 1 through which, in use, a first consumable article 21 containing aerosol-generating material may be inserted into the apparatus 1 and removed from the apparatus 1 by a user.

The bottom panel 19 of the apparatus has a second opening 22 and a door 39 at the distal end 5 for opening and closing the second opening 22 through which, in use, a second consumable article 24 may be inserted into the apparatus 1 and removed from the apparatus 1 by a user. The second consumable article 24 typically comprises a flavorant.

The housing 9 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol-generating material in the consumable article 21 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosol-generating material in the consumable (as discussed, to volatilize the aerosol-generating material without causing the aerosol-generating material to burn).

An advantage of locating the power source 27 laterally adjacent to the heater arrangement 23 is that a physically large power source 27 may be used without causing the apparatus 1 as a whole to be unduly lengthy. As will be understood, in general a physically large power source 27 has a higher capacity (that is, the total electrical energy that can be supplied, often measured in Amp-hours or the like) and thus the battery life for the apparatus 1 can be longer.

In one example, the heater arrangement 23 is generally in the form of a hollow cylindrical tube, having a hollow interior heating chamber 29 into which a first section of which the first consumable article 21 comprising the aerosol-generating material is inserted for heating in use. Different arrangements for the heater arrangement 23 are possible. For example, the heater arrangement 23 may comprise a single heating element or, as is the case in this example, may be formed of plural heating elements 23*a*, 23*b* (see FIG. 3) aligned along the longitudinal axis of the heater arrangement 23 and each may be independently controllable from the other. The or each heating element 23*a*, 23*b* may be annular or tubular, or at least part-annular or part-tubular around its circumference. In an example, the or each heating element 23*a*, 23*b* may be a thin film heater. In another example, the or each heating element 23*a*, 23*b* may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the aerosol-generating material when the first consumable article 21 is inserted in the apparatus 1 so that substantially the whole of the aerosol-generating material is heated in use.

The or each heating element 23*a*, 23*b* may be arranged so that selected zones of the aerosol-generating material can be independently heated, for example in turn (over time) or together (simultaneously) as desired.

The heater arrangement 23 in this example is surrounded along at least part of its length by a thermal insulator 31. The insulator 31 helps to reduce heat passing from the heater arrangement 23 to the exterior of the apparatus 1. This helps to keep down the power requirements for the heater arrangement 23 as it reduces heat losses generally. The insulator 31 also helps to keep the exterior of the apparatus 1 cool during operation of the heater arrangement 23. In one example, the insulator 31 may be a double-walled sleeve which provides a low-pressure region between the two walls of the sleeve. That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The apparatus 1 further comprises a collar 33 which extends around and projects from the opening 20 into the interior of the housing 9 and a generally tubular chamber 35 which is located between the collar 33 and one end of the vacuum sleeve 31.

One end of the chamber 35 connects to and is supported by the collar 33 and the other end of the chamber 35 connects to the one end of the vacuum sleeve 31 and hence supports the vacuum sleeve 31. Accordingly, as best seen in FIG. 3, the collar 33, the chamber 35 and the vacuum tube 31/heater arrangement 23 are arranged co-axially, so that, as best seen in FIG. 2, when the consumable 21 is inserted in the apparatus 1, it extends through the collar 33 and the chamber 35 into the heater chamber 29.

The chamber 35 is shaped so that there is an air gap 36 between the chamber 35 and the first consumable article 21 when it is inserted in the apparatus over at least part of the length of the hollow chamber 35. The air gap 36 is around all of the circumference of the consumable article 21 in that region. The chamber 35 is provided with a series of cooling fins around its exterior.

As is explained in more detail in our co-pending application PCT/EP2017/061520, advantageously, the volume of air surrounding the first consumable article 21 in the fin cooled chamber 35 causes at least some volatilized components that, in use, escape the consumable article 21 through its outer layer to cool and condense on the interior wall of the chamber 35 preventing those volatilized components from being possibly inhaled by a user.

The collar 33 comprises a plurality of ridges 62 (see FIG. 3) that, in use, grip the first consumable article 21. As is also explained in more detail in our co-pending application PCT/EP2017/061520, the cooling effect may be assisted by cool air that is able to enter from outside the apparatus 1 into the space 36 surrounding the consumable article 21 in the chamber 35 via ventilation paths defined between the plurality of ridges 62.

As mentioned above, in this example, the heater arrangement 23 is generally in the form of a hollow cylindrical tube and this tube is in fluid communication with the opening 20 at the mouth end 3 of the device 1 via the chamber 35 and the collar 33.

Referring again to FIGS. 2 and 3, in an example, the heating chamber 29 has a region 38 of reduced internal diameter towards the distal end 5. This region 38 provides an end stop for the first consumable article 21 passed through the first opening 20 at the mouth end 3 and includes a second section 30 of the heating chamber 29 for receiving the second consumable article 24.

This second section 30 of the heating chamber 29 is specifically configured to receive the second consumable article 24 so that the second consumable article 24 is held securely in place at a pre-determined position within the heating chamber 29.

In one example, the second section 30 comprises a tube component, for example a pressed tube component that is generally cylindrical in shape, that has a smaller diameter than that of the second section of the heating chamber 29 and which is located snuggly within the second section of the heating chamber 29 at the correct location for the second consumable article 24. In use, the second consumable article 24 is located within this tube. The tube may have a diameter of around 4 mm to 6 mm, for example 5 mm.

Figure 3A:
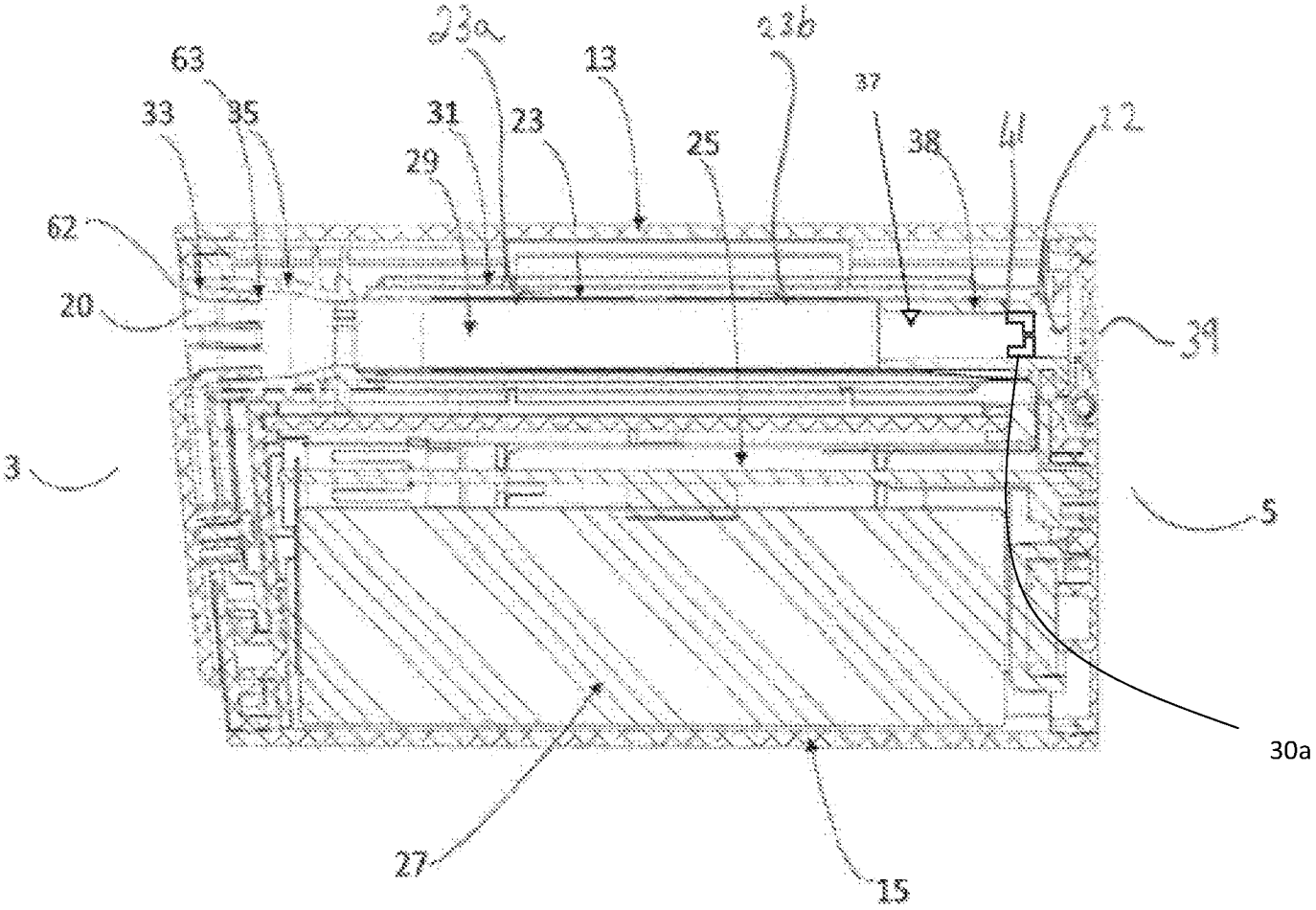
FIG. 3*a* shows a lateral cross-sectional view of the apparatus of FIG. 1 without a first consumable article and a second consumable article inserted.
Figure 3B:
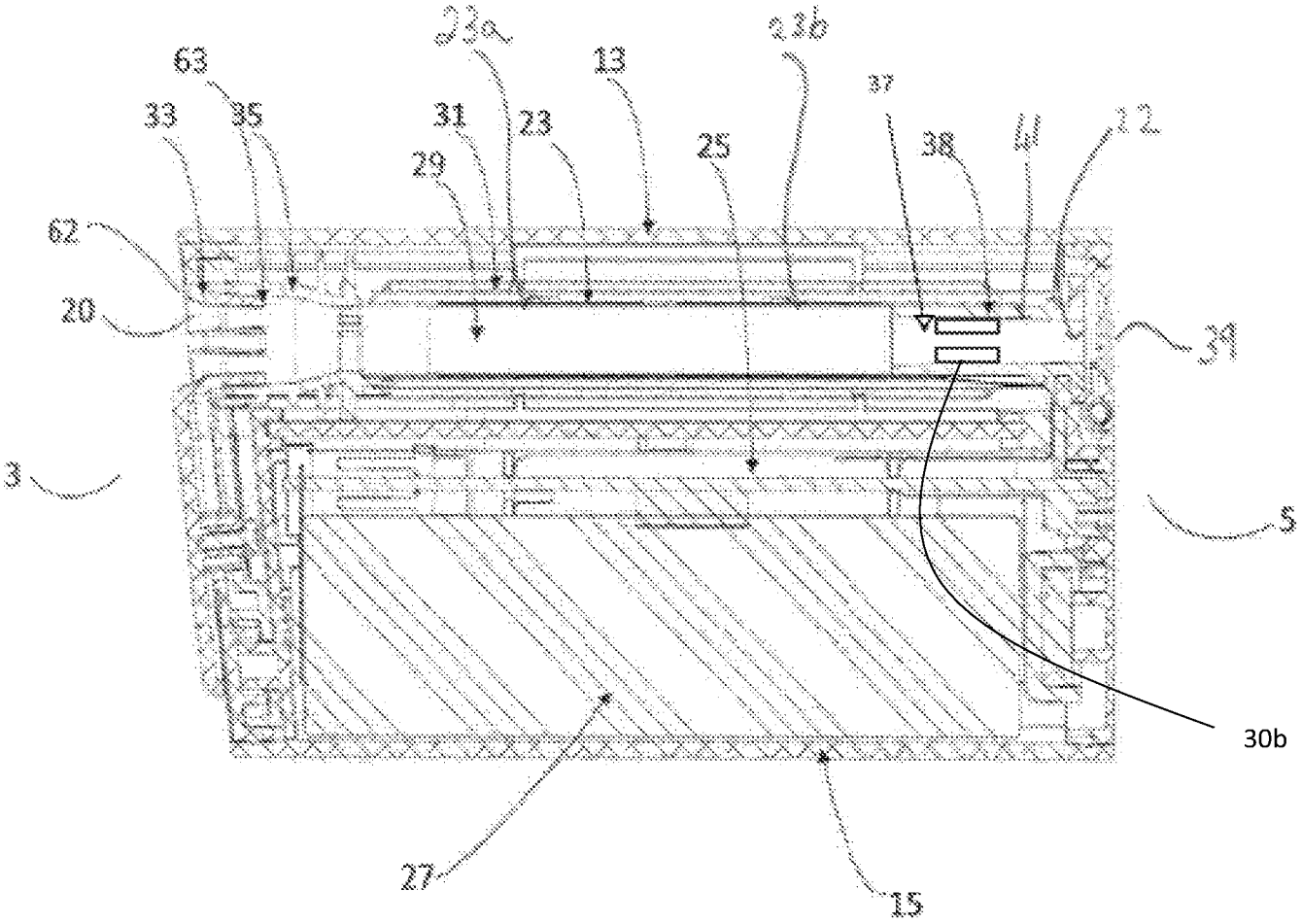
FIG. 3*b* shows a lateral cross-sectional view of the apparatus of FIG. 1 without a first consumable article and a second consumable article inserted.

In alternative arrangements, the second section 30 comprises a support member, for example a bracket 30*a* or similar component as shown in FIG. 3*a*, to hold the second consumable article 24 in the predetermined position within the heating chamber, or one or more ribs 30*b* formed on the inner wall of the cavity as shown in FIG. 3*b*, to locate the second consumable article 24 in the predetermined position, for example.

Figure 4:
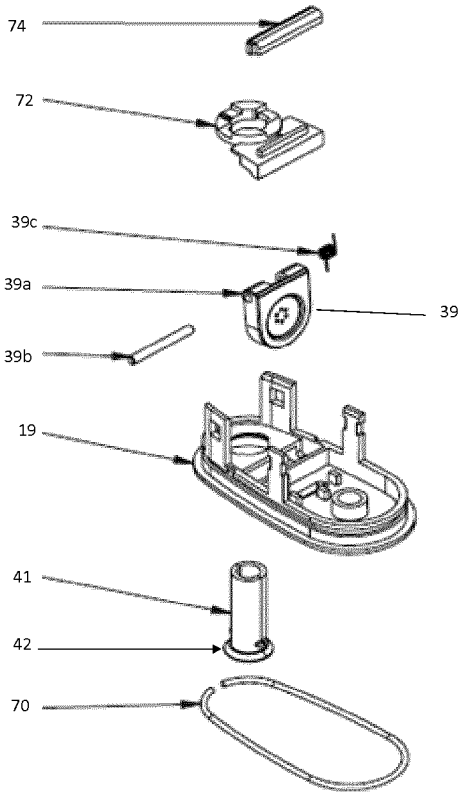
FIG. 4 shows an exploded view of some components of the apparatus of FIG. 1

The region 38 itself may for example, be provided by a hollow tube 41, best seen in FIG. 4, which defines the end of the heating chamber 23 towards the distal end 12. The hollow tube 41 in this example has an outwardly extending head or flange 42. The hollow tube 41 may be formed of for example a plastics material, including for example polyether ether ketone (PEEK). During manufacture of the apparatus 1, the hollow tube 41 is inserted from the outside into the opening 35 at the distal end 12, with the head or flange 42 providing a stop against the door 39 to locate the hollow tube 41 at the predetermined position. The hollow tube 41 may be fixed in place, for example by glue.

In this example, the door 39 is a hinged door comprising a hinge formed by a channel 39*a* for receiving a hinge pin 39*b* about which the door 39 pivots to open and close to provide access to the heating chamber 29. The hinge pin 39*b* may be spring loaded by a spring 39*c* to bias the door 39 towards the closed position.

FIG. 4 is an exploded view illustrating the components of the hollow tube 41, the bottom panel 19, the door 39, the hinge pin 39*b* and the spring 39*c*. In some examples, an o-ring seal 70 for forming a seal between the bottom panel 19 and the uni-body panel 11, a door retainer 72 for retaining door 39 and an additional seal 74 may be provided.

Advantageously, the door 39 at the distal end 5 that opens and closes the opening 22 provides a dual function in that it allows access to the heating chamber 29 so that the heating chamber can be cleaned by a user and it allows a user to locate the second consumable article 24 into the heating chamber.

Examples of suitable doors are also discussed in more detail in our application U.S. 62/185,227.

Referring again particularly to FIG. 2, in one example, the first consumable article 21 is in the form of a cylindrical rod which has or contains aerosol-generating material 21*a* at a rear end in a section of the consumable article 21 that is within the heating arrangement 23 when the consumable article 21 is inserted in the apparatus 1. A front end of the consumable article 21 extends from the apparatus 1 and acts as a mouthpiece assembly 21*b* which includes one or more of a filter for filtering aerosol and/or a cooling element 21*c* for cooling aerosol. The filter/cooling element 21*c* is spaced from the aerosol-generating material 21*a* by a space 21*d* and is also spaced from the tip of mouthpiece assembly 21*b* by a further space 21*e*. The consumable article 21 is circumferentially wrapped in an outer layer (not shown). In one example, the outer layer of the consumable article 21 is permeable to allow some heated volatilized components from the aerosol-generating material to escape the consumable article 21.

The second consumable article 24 comprises at least one flavorant. In some examples, the second consumable article 24 may be a capsule that comprises a protective layer 24*a*, for example, a membrane or coating or the like that encapsulates the at least one flavorant 24*b*, which may for example be a liquid. In these examples, the protective layer 24*a* is broken in order to expose the at least one flavorant.

In some examples, the protective layer 24*a* that encapsulates the at least one flavorant 24*b* breaks down to release or expose the flavorant when the second consumable 24 is heated by the heater arrangement 23.

In other examples, the protective layer 24*a* may be manually broken by a user prior to the user inserting the second consumable article 24 into the apparatus 1 or the apparatus 1 may be provided with a mechanism, for example, a spike or the like (labelled 37 in FIG. 3), for breaking the protective layer 24*a* when the second consumable article 24 is in the process of bring inserted into the article 1 or, for example, when the door 39 is being shut after the second consumable article 24 has been inserted into the article 1.

In other examples, the second consumable article 24 comprises a medium that is impregnated with the flavorant. The medium may take any suitable form, for example, paper, Cellulose Acetate (CA) or a thermoplastic such as polylactic acid (PLA). In these examples, the flavorant need not be encapsulated.

In other examples, the second consumable article may comprise a self-supporting flavor material (i.e. a material not encapsulated or held in a support medium), for example a self-supporting gel.

In all examples, the flavorant may be in any suitable form and, for example, may be solid, liquid, gel, powder or a foam.

In some examples, the flavorant itself may be or comprise tobacco or a tobacco based material so as to provide a tobacco flavor.

In some examples, the second consumable article may be rod shaped and hence if the flavorant comprises tobacco may resemble a cigarette.

In the particular example illustrated in FIGS. 1 to 4, in operation, the heater arrangement 23 heats the first consumable article 21 to volatilize at least one component of the aerosol-generating material 21*a* and heats the second consumable 24 to break the protective layer 24*a* to release or expose the flavorant 24*b*.

As a user draws on the mouthpiece assembly 21*b*, the primary flow path for the heated volatilized components from the aerosol-generating material 21*a* is axially through the first consumable article 21, through the space 21*d*, the filter/cooling element 21*c* and the further space 21*e* before entering a user's mouth through the open end of the mouthpiece assembly 21*b*.

When heat from the heater arrangement 23 breaks the membrane 24*a* to release the liquid flavorant 24*b*, the liquid flavorant 24*b* is volatilized, flows through the first consumable article 21 and mixes with the flow of volatilized components from the aerosol-generating material 21*a*.

Similarly, in examples in which the membrane 34 is mechanically broken prior to heating or the flavorant is not encapsulated but is supported in a material such as CA or is self-supporting, heat from the heater arrangement 23 volatizes the flavorant 24 and, as a user draws on the mouthpiece assembly 21*b*, volatized flavorant flows through the first consumable article 21 and mixes with the flow of volatilized components from the aerosol-generating material 21*a*.

Advantageously, the second section of the heating chamber 29 that contains the second consumable article 24 is upstream of the first section of the heating chamber 29 that contains the first consumable article 21. This enables the flavorant once it has been volatized to flow axially through the whole length of the first consumable article 21 mixing with the heated volatilized components from the aerosol-generating material 21*a*.

In one example, the heater arrangement 23 comprises a first heater section 23*a* and a second heater section 23*b* that are in co-axial alignment with each other. As best seen in FIG. 3, the second heater section 23*b* is located next to the region 38 that receives the second consumable article 24 and the first heater section 23*a* is located closer to the proximal end 3 of the device 1 than is the second heater section 23*b*.

The control circuitry 25 may be configured to control the heating arrangement 23 to implement a pre-determined heating profile during a user's smoking session.

In one example heating profile, only the first heater section 23*a* is activated during a first part of the heating profile in order to heat the aerosol-generating material 21*a* to generate the flow of heated volatilized components from the aerosol-generating material 21*a*. However, the heat energy released by the first heater section 23*a* during the first part of the heating profile is insufficient to break the membrane 24*a* so that no flavorant 24*b* is released during the first part of the heating profile.

During a second part of the heating profile the second heater section 23*b* is activated in order to heat the aerosol-generating material 21*a*. Due to its proximity to the second consumable article 24, the heat energy released by the second heater section 23*b* during the second part of the heating profile is sufficient to break the membrane 24*a* so that flavorant 24*b* is released during the second part of the heating profile. Advantageously, this may enhance the user's sensorial experience during the smoking session with the user experiencing a perception of extra flavor in the last few draws of the smoking session.

It will be appreciated that other heating profiles may be used and indeed that the release profile of the flavor will be function of various different factors including the heating profile used, the temperatures involved in that heating profile, the nature of the flavorant being used and the nature of any material that is encapsulating the flavorant being used.

As used herein, the terms "flavor" and "flavorant" may refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, solid, or powder. For example, a liquid, oil, or other such fluid flavorant may be impregnated in a porous solid material so as to impart flavor and/or other properties to that porous solid material. As such, the liquid or oil is a constituent of the material in which it is impregnated.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An apparatus arranged to heat aerosol-generating material to volatilize at least one component of the aerosol-generating material, the apparatus comprising:

a housing, the housing comprising a first opening and a chamber comprising a first section and a second section, wherein a first consumable article comprising aerosol-generating material can be inserted through the first opening to be received within the first section of the chamber in use; and a heater arrangement within the housing for heating the aerosol-generating material received within the first section of the chamber in use to generate a flow of aerosol;

wherein the second section of the chamber is upstream of the first section of the chamber and is configured to receive a second consumable article comprising a flavorant; and wherein the second section of the chamber comprises one or more ribs for receiving the second consumable article.

2. The apparatus according to claim 1, wherein the housing comprises a second opening, wherein the second consumable article can be inserted into the second section of the chamber through the second opening.

3. The apparatus according to claim 2, wherein a user can access the chamber through the second opening to clean within the apparatus.

4. The apparatus according to claim 2, wherein the first opening is at a first end of the apparatus and the second opening is at a second end of the apparatus.

5. The apparatus according to claim 4, wherein the first opening is at a proximal end of the apparatus and the second opening is at a distal end of the device.

6. The apparatus according to claim 2, comprising a door for selectively covering the second opening, the door being movable between a first position in which the second opening is closed by the door and a second position in which the second opening is open.

7. The apparatus according to claim 1, wherein the second section of the chamber comprises a support member at a pre-determined position within the chamber for receiving the second consumable article.

8. The apparatus according to claim 1, wherein the heater arrangement is for heating the second consumable article to generate a flow of the flavorant.

9. The apparatus according to claim 8, wherein the heater arrangement comprises a first heater and a second heater, wherein the apparatus is operable, in use, such that the apparatus operates the first heater in a first time period to heat the aerosol-generating material to generate a flow of aerosol and operates the second heater in a second time period that is subsequent to the first time period and wherein the second heater is closer to the second consumable article than is the first heater.

10. The apparatus according to claim 9, wherein the second consumable article comprises a protective layer that encapsulates the flavorant and wherein heat generated by the heating arrangement breaks the protective layer during the second time period to release the flavorant.

11. The apparatus according to claim 1 wherein the second consumable article comprises a protective layer that encapsulates the flavorant and the apparatus comprises an arrangement for rupturing the protective layer to expose the flavorant.

12. A system comprising:

the apparatus according to claim 1; and the second consumable article for being received in the second section.

13. The system according to claim 12, wherein the second consumable article is located in the second section.

14. The system according to claim 12, wherein the second consumable article comprises a capsule comprising a protective layer encapsulating the flavorant.

15. The system according to claim 12, wherein the second consumable article comprises a medium impregnated with the flavorant.

16. The system according to claim 12, wherein the second consumable article comprises a self-supporting flavorant material.

17. A method of using the apparatus of claim 1, the method comprising:

inserting a first consumable article comprising an aerosol-generating material through the first opening to be received within the first section of the chamber;

inserting a second consumable article comprising a flavorant into the second section of the chamber upstream of the first section of the chamber;

using the heater arrangement to heat the aerosol-generating material received within the first section of the chamber to generate a flow of aerosol; and generating a flow of flavorant from the second consumable article.

* * * * *